United States Patent [19]

Schintgen

[11] Patent Number: 4,887,514

[45] Date of Patent: Dec. 19, 1989

[54] OIL SEPARATION AND GAS PRESSURE EQUALIZER MEANS FOR RECIPROCATING GAS COMPRESSOR

[75] Inventor: Robert J. Schintgen, New Berlin, Wis.

[73] Assignee: Vilter Manufacturing Corporation, Milwaukee, Wis.

[21] Appl. No.: 273,242

[22] Filed: Nov. 18, 1988

[51] Int. Cl.[4] ..... F15P 21/04; F01B 31/18

[52] U.S. Cl. ..... 92/79; 92/86; 92/147; 92/153; 92/161; 55/80; 55/81; 55/201

[58] Field of Search ..... 92/78, 79, 86, 146, 92/147, 148, 153, 161; 55/52, 80, 81, 183, 185, 199, 201; 417/281, 426

[56] References Cited

U.S. PATENT DOCUMENTS

| | | | |
|---|---|---|---|
| 920,421 | 5/1909 | Boland | 92/79 X |
| 1,872,805 | 8/1932 | Peterson | 92/79 X |
| 2,005,959 | 6/1935 | Smith | 92/79 X |
| 2,781,632 | 2/1957 | Meijer | 92/79 X |
| 2,844,305 | 7/1958 | Becht et al. | 92/78 |
| 3,844,688 | 10/1974 | Bulkley et al. | 92/79 X |
| 4,005,763 | 2/1977 | Wallis | 92/153 X |

FOREIGN PATENT DOCUMENTS

| | | | |
|---|---|---|---|
| 722484 | 7/1942 | Fed. Rep. of Germany | 92/147 |
| 1123075 | 2/1962 | Fed. Rep. of Germany | 92/86 |
| 1293084 | 4/1962 | France | 92/148 |

*Primary Examiner*—Robert E. Garrett
*Assistant Examiner*—M. A. Williamson
*Attorney, Agent, or Firm*—James E. Nilles; Thomas F. Kirby

[57] ABSTRACT

A housing of a reciprocating gas compressor comprises a partition member separating an upper suction chamber through which gas passes and a lower crankcase chamber in which a crankshaft rotates and which has an oil sump at the bottom. The partition member is imperforate except for sealed openings through which cylinder sleeves and hydraulic fluid lines extend between the chambers. A conduit located on the housing exterior and connected between the chambers performs three functions, namely: enables gas flow in either direction to effect pressure equalization; enables oil to flow by gravity from low points in the upper chamber into the sump; and enables oil mist in the gas flow through the conduit to coalesce on the inner walls of the conduit and flow by gravity into the sump. The conduit includes two upper tubes, each having one end connected to a low point in the suction chamber adjacent the partition member where oil collects, and each having its other end connected by a T-connector to a third tube which has its lower end connected at a point in the lower chamber above the oil level in the oil sump and clear of the crankshaft rotation path.

10 Claims, 3 Drawing Sheets

OIL SEPARATION AND GAS PRESSURE EQUALIZER MEANS FOR RECIPROCATING GAS COMPRESSOR

BACKGROUND OF THE INVENTION

1. Field of Use

This invention relates generally to oil separator and gas pressure equalizer means for reciprocating gas compressors.

2. Description of the Prior Art

A typical multicylinder reciprocating type gas compressor comprises a housing having a partition member therein which divides the space within the housing into an upper suction chamber and a lower crankcase chamber, the lowest portion of which serves as an oil sump. The partition member is provided with relatively large openings in which cylinder sleeves are mounted and pistons are slidably mounted for reciprocating motion in the cylinder sleeves to compress gas passing through the suction chamber. The pistons are connected by piston rods, which are provided with piston rod bearings, to a crankshaft which is rotatably mounted on crankshaft bearings in the lower crankcase chamber. The partition member also supports capacity reduction mechanisms which are located in the upper suction chamber and which operate gas inlet valves which are located at the upper ends of the cylinder sleeves. Each capacity reduction mechanism, which operates one or more gas inlet such valves, is hydraulically controlled by hydraulic fluid which flows through a hydraulic fluid line which extends through a relatively small opening provided in the partition member. In some prior art compressors, the partition is also provided with a small pressure equalizer or vent hole which serves to provide for gas pressure equalization between the suction chamber and the crankcase chamber and thereby improve the efficiency of the refrigeration system.

Furthermore, some gas leaks past the seals for the large and small openings through the partition member.

During compressor operation, lubricating oil is supplied under pressure through passages in the housing, crankshaft and piston rods to the piston rod bearings and crankshaft bearings in the crankcase. As oil drains out of the bearings during crankshaft rotation, oil droplets are flung about the crankcase chamber and eventually drain into the oil sump from whence the oil is recovered and recirculated. Because of the "blow-by" phenomena which occurs as the pistons compress the gas, some gas leaks past the pistons and rings and tends to pressurize the crankcase. As this gas is vented back to the suction chamber, it carries oil mist through the vent hole into the suction chamber where they mix with the gas being drawn into the cylinders compressed and expelled into the system. This is undesirable for two reasons. First, most of such oil is lost into the refrigeration system and is no longer available in the sump for lubrication purposes. Over time, the amount of oil lost is substantial and is costly to replace. Second, such oil contaminates both the refrigerant gas and the refrigeration system and reduces system efficiency.

As a practical matter, some of the oil mist coalesces in the suction chamber and collects on the partition but is able to drain back into the crankcase chamber through the pressure equalizer hole and into the oil sump therein. However, oil dripping or draining through the pressure equalizer hole falls onto the rotating crankshaft and is flung about the crankcase chamber in the form of mist causing some mist to be expelled up through the pressure equalizer hole back into the suction chamber.

SUMMARY OF THE INVENTION

The present invention provides improved oil separator and gas pressure equalizer means for reciprocating gas compressors of the aforedescribed type. The invention is particularly adapted to a reciprocating gas compressor comprising a compressor housing having an upper suction chamber through which gas passes; a lower crankcase chamber located below the suction chamber and having an oil sump at the lowest portion thereof; and a partition member within the housing separating the two chambers, said partition member having openings therethrough for accommodating components which extend between said chambers, such as cylinder sleeves and hydraulic fluid lines for the capacity reduction mechanisms, as well as an opening for pressure equalization between the two chambers.

The improved means in accordance with the invention further require that the partition member be imperforate in that the pressure equalizer hole therein be eliminated, or at least sealed, and that sealing means be provided for sealing the openings in said partition member through which the aforesaid components extend, namely cylinder sleeves and hydraulic fluid lines, to thereby prevent passage of gas and oil in either direction through such openings between the two chambers.

The improved means comprises conduit means externally connected between the two chambers to enable gas flow in either direction between the two chambers to equalize gas pressure therebetween and to enable oil collected in the suction chamber to flow by gravity in one direction from the suction chamber into the oil sump in the crankcase chamber without intersecting the path of travel of the crankshaft or piston rods. The conduit also acts as an oil separator by collecting the oil mist that is being carried from the crankcase to the suction chamber with the "blow-by" gas as it equalizes from the crankcase to the suction chamber. The oil mist collects on the inside walls of the conduit and drain back to the crankcase while the blow-by gas vents back to the suction chamber. More specifically, since the conduit is in a cooler atmosphere than the hot oil mist that is entrained with the gas that flows up through the conduit, the oil mist coalesces on the wall of the conduit into droplets that are heavy enough to flow by gravity back to the crankcase. In its broad aspect, the conduit means includes at least one tube having one end connected to the suction chamber at a location adjacent said partition member therein which is a low point wherein oil collects and having its other end connected to the crankcase chamber at a location adjacent the oil sump, above the level of any oil in the sump and clear of the path of travel of any movable component in the crankcase chamber, such as the crankshaft and piston rods.

In the preferred embodiment disclosed herein, the conduit means includes an assembly of three tubes: two connected to two spaced apart low-point locations in the suction chamber and joined to a third tube which is connected to the aforedescribed location in the crankcase chamber.

In operation, oil flows by gravity in one direction through the conduit means from the suction chamber to the oil sump in the crankcase chamber. Gas, responding to pressure differentials between the two chambers, flows in either direction through the same conduit means. Since the conduit is in a cooler atmosphere than the hot oil mist that is entrained with the gas that flows up through the conduit, the oil mist coalesces on the wall of the conduit into droplets that are heavy enough to flow by gravity back to the crankcase.

This invention offers several advantages over the prior art. For example, the openings in the partition member through which components, such as the cylinder sleeves and hydraulic fluid lines, extend are provided with improved seals which prevent passage of oil and gas between the chambers and the partition member is otherwise imperforate in that all other holes, such as the gas pressure equalizer or vent hole, through the partition member are eliminated. Thus, oil collected in the suction chamber cannot drip onto the crankshaft or other movable components in the crankcase chamber, either through vent holes or as a result of leakage through the large and small openings. Thus, oil cannot drip into the crankcase and be flung back into the suction chamber.

Furthermore, the conduit means delivers oil collected at one or more low points in the suction chamber or within the conduit means by means of a tube or tubes directly into the oil sump, out of the path of travel of movable components, and there is no risk of the oil dripping onto the rotating crankshaft or other movable component in the crankcase chamber.

In addition, the same consuit means which accommodate oil flow by gravity in one direction also accommodate gas flow in either direction between the two chambers to equalize gas pressure.

The tube assembies of the conduit means are very simple and economical to manufacture from standard, commercially available tubing and fittings, as compared to some types of prior oil separators which require a relatively large special tank or container to which tubing is connected. The tube assembies according to the invention are simple and reliable in use.

Other objects and advantages of the invention will hereinafter appear.

DRAWINGS

DESCRIPTION OF A PREFERRED EMBODIMENT

Figure 1:
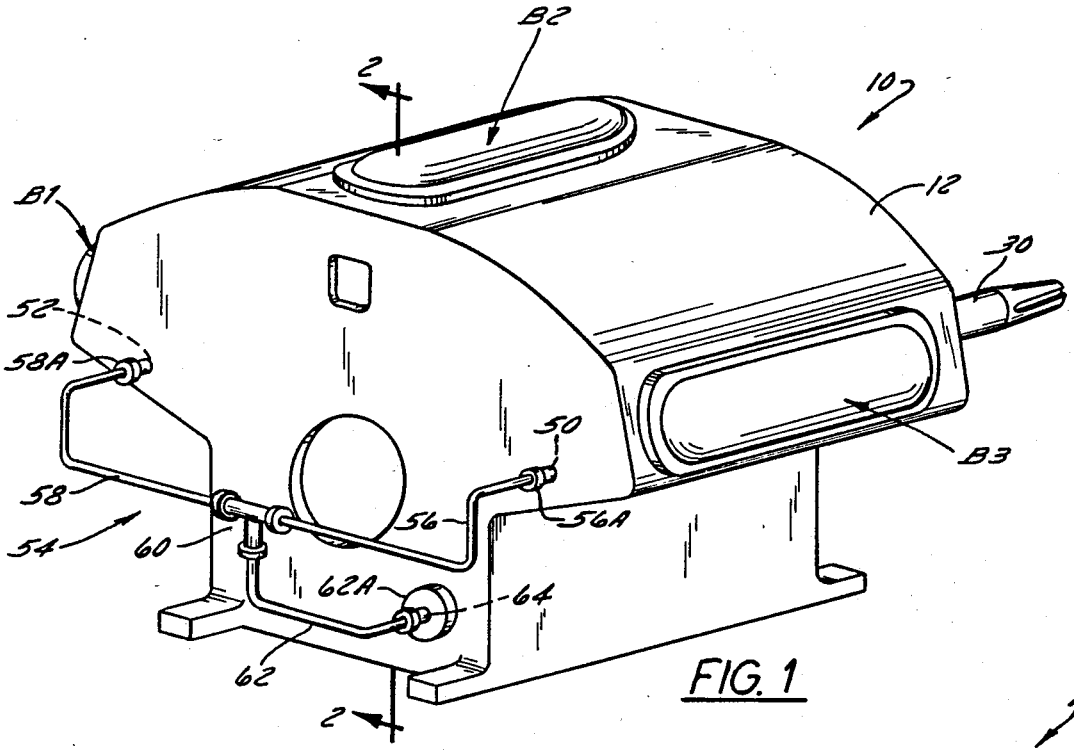
FIG. 1 is a perspective view of a reciprocating type gas compressor embodying oil separator and gas pressure equalizer means in accordance with the present invention.
Figure 5:
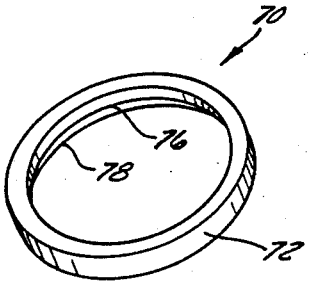
FIG. 5 is a perspective view of the cylinder sleeve sealing assembly shown in FIGS. 3 and 4.
Figure 3:
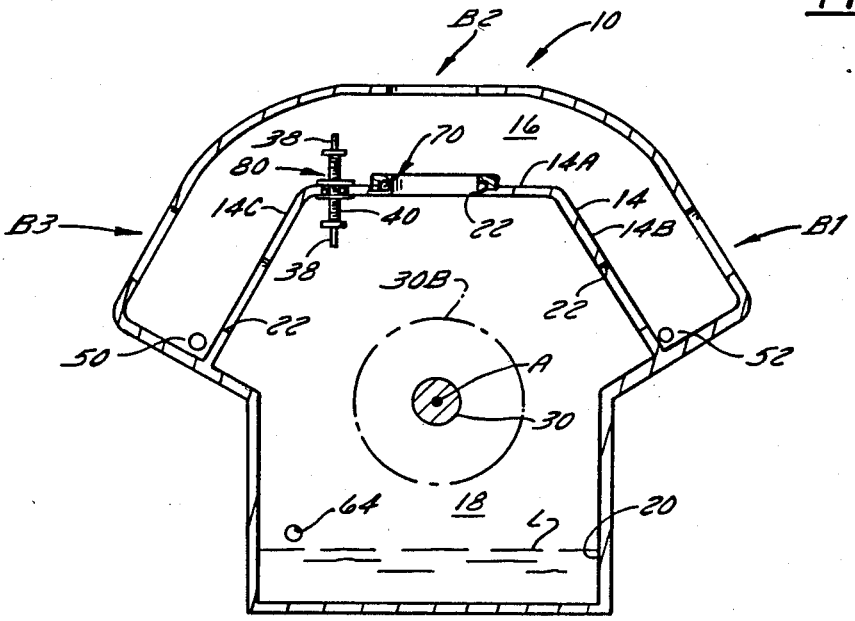
FIG. 3 is a cross-section view taken generally on line 3-3 of FIG. 2 with certain details omitted for the sake of clarity.
Figure 2:
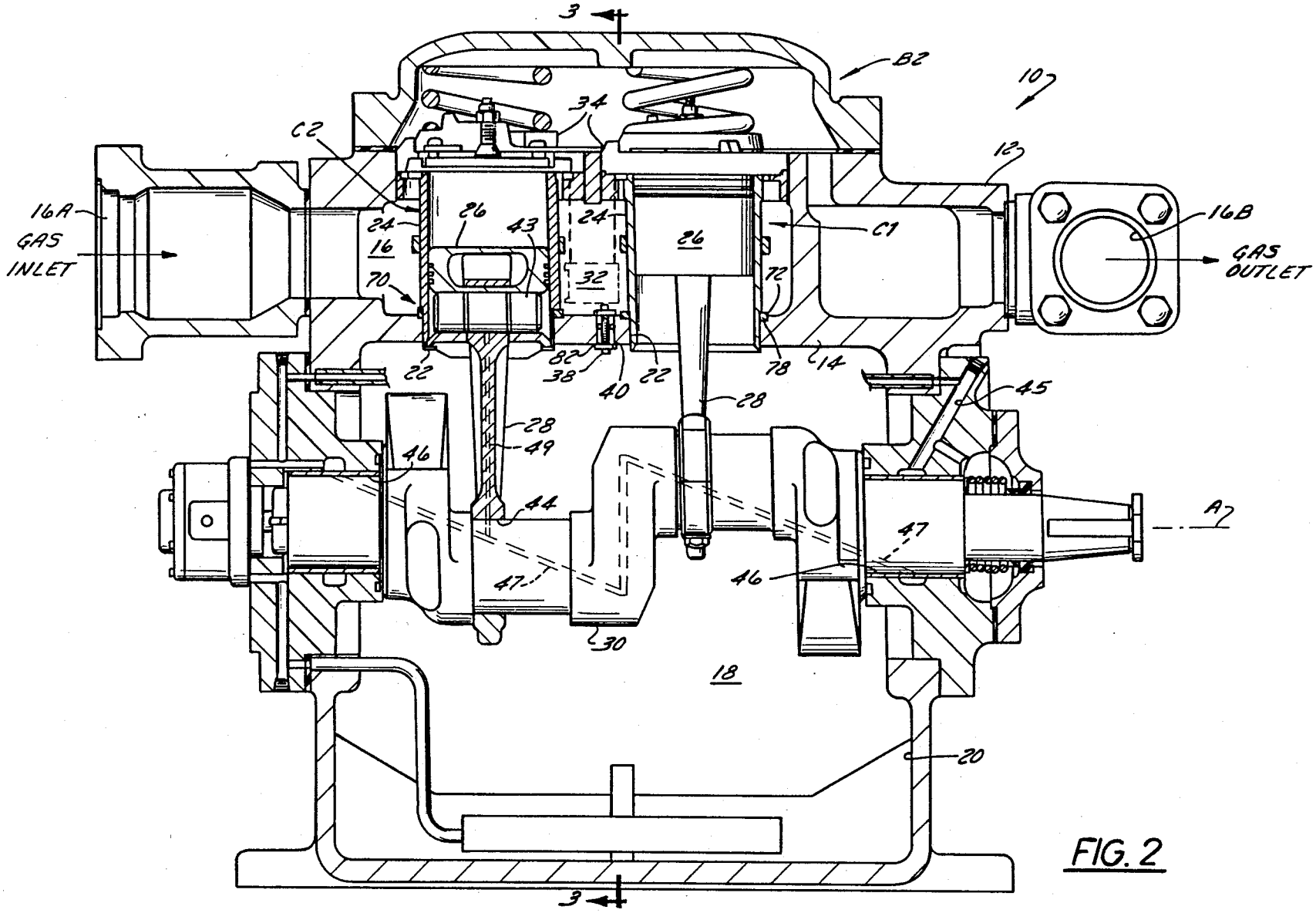
FIG. 2 is an enlarged cross-section view of the compressor taken on line 2—2 of FIG. 1.
Figure 4:
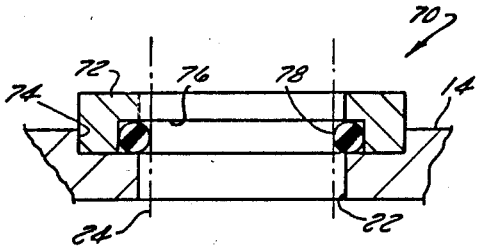
FIG. 4 is an enlarged cross-section view of a cylinder sleeve sealing assembly shown in FIG. 3.
Figure 6:
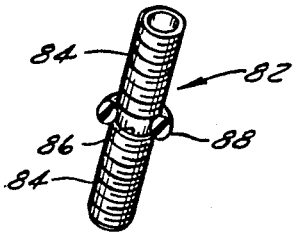
FIG. 6 is an enlarged perspective view of a hydraulic fluid line sealing assembly shown in FIGS. 2 and 3.

FIGS. 1, 2 and 3 show a reciprocating type gas compressor 10 incorporating oil separator and gas pressure equalizer means in accordance with the present invention. Compressor 10, which is used, for example, in a refrigeration system (not shown) is a multicylinder compressor which comprises three cylinder banks B1, B2 and B3, with two cylinders, such as C1 and C2 (see FIG. 2), in each bank. The present invention may be embodied, for example, in a type of compressor shown in Bulletin 320–340 issued January 1974 by the assignee of the present application.

Referring to FIGS. 2 and 3, compressor 10 comprises a housing 12 having a partition member 14 integrally formed therein which divides the space within the housing into an upper suction chamber 16 and a lower crankcase chamber 18. The lowest portion of crankcase chamber 18 serves as an oil sump 20. Partition member 14 is provided with relatively large circular openings 22 in which tubular cylinder sleeves 24 are mounted and pistons 26 are slidably mounted for reciprocating motion in the cylinder sleeves to compress gas passing through suction chamber 16 from a gas inlet 16A to a compressed gas outlet 16B. Compressor 10 comprises a total of six cylinders (exemplified by cylinders C1 and C2 in FIG. 2) and partition member 14 is provided with six openings 22 to accommodate six cylinder sleeves 24. Since the cylinder banks B1, B2 and B3 are radially arranged and circumferentially spaced apart relative to the axis of rotation A (FIGS. 2 and 3) of a crankshaft 30, partition member 14 is shaped, as FIG. 3 shows, so as to have a flat horizontal intermediate portion 14A and flat sloped side portions 14B and 14C.

The pistons 26 are connected by piston rods 28 to crankshaft 30 which is rotatably mounted in lower crankcase chamber 18. Crankshaft 30 is rotatably supported at opposite ends on crankshaft bearings 46 which, in turn, are mounted on housing 12. Crankshaft 30, when rotating, traverses a path depicted by broken line 30B in FIG. 3. Each piston rod 28 is connected to its respective piston 26 and to crankshaft 30 by suitable bearings 43 and 44, respectively. As FIG. 2 shows, lubricating oil is supplied under pressure to the bearings 46, 44 and 43 through passages 45, 47 and 49, respectively, formed in housing 12, crankshaft 30 and piston rod 28, respectively.

Partition member 14 also supports capacity reduction mechanisms 32, one shown schematically in FIG. 2, located in upper suction chamber 16 which operate gas inlet valves 34 and located at the upper end of each cylinder sleeve 24. Each mechanism 32, which operates two such valves 34, is hydraulically controlled by hydraulic fluid which flows through a hydraulic fluid line 38 which extends through a relatively small opening 40 provided in partition member 14.

During compressor operation, lubricating oil is supplied under pressure to the piston rod bearings 44 and 43 and to the crankshaft bearings 46 in crankcase chamber 18. As oil drains out of the bearings 44, 43 and 46 during crankshaft rotation, oil droplets (not shown) are flung about crankcase chamber 18 and eventually drain into oil sump 20 from whence the oil is recovered and recirculated by pump means (not shown). However, because of the "blow-by" phenomena which occurs as the pistons 26 reciprocate and compress the gas, some gas leaks past the pistons 26 and piston rings and tends to pressurize crankcase chamber 18. As this gas is vented back to suction chamber 16, it carries oil mist which, if allowed to return to suction chamber 16, would mix with the compressed gas being expelled from suction chamber 16 through outlet 16B. This is undesirable for two reasons. First, most of such oil would be lost into the refrigeration system (not shown) and would no longer be available in sump 20 for lubrication purposes. Over time, the amount of oil lost would be substantial and costly to replace. Second, such oil would contaminate both the refrigerant gas and the refrigeration system and reduce system efficiency. As a practical matter, some of the oil mist reaching the suction chamber 16 coalesces in suction chamber 16 and collects on partition 14. As FIG. 3 makes clear, the oil eventually collects at the low points 50 and 52 in suction chamber 16 defined by the corners at which the sloped inside portions 14C and 14B, respectively, of partition 14 join housing 12.

Referring to FIGS. 1, 3, 7 and 8, the oil separator and gas pressure equalizer means comprises conduit means 54 connected between the chambers 16 and 18 to enable gas flow in either direction between the chambers to effect gas pressure equalization and to enable oil to flow by gravity in one direction from suction chamber 16 into oil sump 20 in crankcase chamber 18. The conduit means 54 also acts as an oil separator by collecting the oil mist and droplets that are being carried from crankcase chamber 18 to suction chamber 16 with the "blow-by" gas as it equalizes from the crankcase chamber to the suction chamber. Since the conduit is in a cooler atmosphere than the hot oil mist that is entrained with the gas that flows up through the conduit, the oil mist coalesces on the wall of the conduit into droplets that are heavy enough to flow by gravity back to the crankcase. The oil mist and droplets collect on the inside walls of the conduit means 54 and drain back to the crankcase chamber 18 while the blow-by gas flows back to suction chamber 16 through the conduit means 54.

Figure 7:
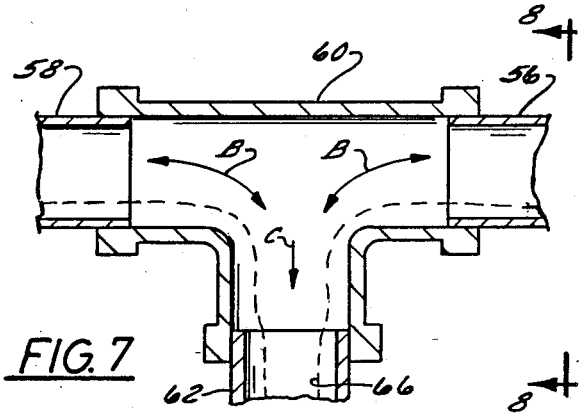
FIG. 7 is a greatly enlarged cross-section view of a tee-fitting of a conduit means shown in FIG. 1.
Figure 8:
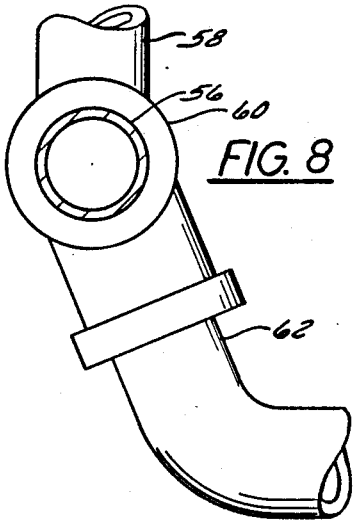
FIG. 8 is a view, partly in cross-section, take on line 8—8 of FIG. 7.

In the preferred embodiment disclosed herein, and as FIG. 1 best shows, the conduit means 54 includes an assembly of three tubes: two tubes 56 and 58 connected to the spaced apart low-point locations 50 and 52, respectively, in suction chamber 16 and joined by a tee connector 60 to a third tube 62 which is connected to a location 64 (FIG. 3) in crankcase chamber 18. Tubes 56 and 58 have one end connected to suction chamber 16 at the locations 50 and 52, respectively, adjacent partition member 14 by fittings 56A and 58A, respectively. Each tube 56 and 58 has its other end connected to tee connector 60. Third tube 62, which has its upper end connected to tee connector 60, has its other end connected by a fitting 62A to crankcase chamber 18 at location 64 which, as FIG. 3 makes clear, is adjacent oil sump 20, above the level of any oil in the sump, and clear of travel path 30B. As FIG. 7 shows, oil flows by gravity in one direction (arrow C). Gas, responding to pressure differentials between the two chambers 16 and 18, flows in either direction (arrows B) through the same tubes. Typically, the oil moves either in "slugs" through tubes 56 and 58 when gas pressure between the two chambers is equal and, being viscous, can also flow along only the inside walls of the tubes 56, 58, 62, as at 66 in FIG. 7, while gas flows past in either direction. Oil mist also coalesces on the walls of the tubes and drains by gravity. As FIG. 8 shows, tee fitting 60 pitches inwardly toward housing 12 to improve gravity flow of the oil.

In the preferred embodiment disclosed, the conduit means 54 is located externally of compressor housing 12 and, furthermore, is constructed to communicate with two spaced-apart low points 50 and 52 at which oil collects in suction chamber 16. However, the conduit means could be arranged and constructed within housing 12, provided that its mechanical components do not interfere with the path of rotation 30B of crankshaft 30 or any other movable components within housing 12. It is also within the scope of the present invention to employ conduit means which communicates with only a single low point in a suction chamber in a compressor, instead of the two low points 50 and 52 herein disclosed.

Referring now to FIGS. 2, 3, 4, 5, 6 and 9, improved sealing means, including sealing assemblies 70 and 80 for openings 22 and 40, respectively, in partition member 14 will now be described. The sealing means prevent passage and leakage of gas and oil in either direction between the chambers 16 and 18 through spaces between the openings 22 and 40 and the components mounted therein. Furthermore, any other holes in partition member 14, such as gas pressure equalizer holes, are eliminated and partition member 14 is otherwise imperforate.

As FIGS. 2, 3, 4, and 5 make clear, each sealing assembly 70 for a respective cylinder sleeve 24 in an opening 22 takes the form of an annular metal member or ring 72 which is secured, as by a press-fit, into an annular groove 74 formed in the upper surface of partition member 14 and surrounding a respective sleeve-accommodating opening 22 in the partition member. Ring 72 has an annular groove 76 on its underside for accommodating an O-ring 78 which fits snuggly in between the confronting surfaces of the grooves 74 and 76 and against the outside of the associated sleeve 24.

Figure 9:
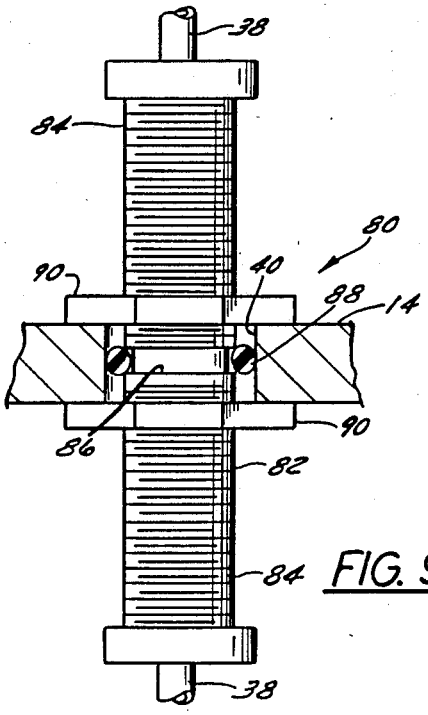
FIG. 9 is a greatly enlarged view, partly in cross-section of the hydraulic fluid line sealing assembly of FIG. 6 which is installed in an opening in a partition member as shown in FIG. 3.

As FIGS. 2, 3, 6 and 9 make clear, each sealing assembly 80 for a respective hydraulic fluid line 38 which extends through an opening 40 in partition member 14 takes the form of a nipple 82, threaded at opposite ends as at 84, and having an annular groove 86 thereabout for accommodating an O-ring 88 therearound. When installed, as shown in FIG. 9, nipple 82 is part of hydraulic fluid line 38 and is secured in opening 40 in partition member 14 by two nuts 90 which screw onto the threaded ends 84 and bear against opposite sides of partition member 14 so that O-ring 88 fits snuggly within and seals opening 40.

In an actual embodiment of the invention which was constructed and tested, the tubes 56, 58 and 62 each had an inside diameter of about ⅜ inches and the passages in tee-connector 60 were of slightly larger diameter. Oil flow from the end of tube 62 while compressor 10 was in operation took the form of a steady, relatively rapid drip. Gas pressure differentials between chambers 16 and 18 were such that gas pressure within the conduit means 54 was relatively nominal and varied with operating conditions of the compressor.

I claim:

1. In a reciprocating gas compressor having a housing which is divided by a partition member therein into an upper suction chamber through which gas passes and a lower crankcase chamber in which a component moves along a path, said suction chamber having a location whereat oil collects and said crankcase chamber having an oil sump wherein oil collects;

conduit means externally connected between said suction chamber and said crankcase chamber to enable oil collected at said location in said suction chamber whereat oil collects to flow by gravity through said lower crankcase chamber clear of said path and into said oil sump, to enable gas to flow in either direction between said suction chamber and said crankcase chamber to equalize gas pressure between the chambers and to enable oil droplets in said gas to flow by gravity through said conduit means and through said lower crankcase chamber clear of said path and into said oil sump.

2. A compressor according to claim 1 wherein said conduit means comprises at least one tube having one end connected at said location in said suction chamber whereat oil collects and having another end connected at a location in said crankcase chamber above the level of oil in said oil sump and clear of said path.

3. A compressor according to claim 1 wherein said suction chamber has two spaced apart locations whereat oil collects and wherein said conduit means comprises first and second tubes, each having one end connected at one of said locations whereat oil collects in said suction chamber, and means for connecting the other ends of said first and second tubes at a location in said crankcase chamber above the level of oil in said oil sump and clear of said path.

4. A compressor according to claim 3 wherein said means for connecting the other ends of said first and second tubes comprises a tee-connector to which said other ends of said first and second tubes are connected, and a third tube connected between said tee-connector and said location in said crankcase chamber.

5. A compressor according to claim 1 or 2 or 3 or 4 further comprising components which extend between said chambers, wherein said partition member comprises openings therethrough for accommodating said components; and wherein said compressor further comprises sealing means for sealing spaces between said openings and said components disposed therein to prevent oil or gas flow between said chambers through said space.

6. A compressor according to claim 5 wherein said components include cylinder sleeves and wherein said sealing means comprises, for each cylinder sleeve, an annular member which surrounds an associated cylinder sleeve and is rigidly secured to said partition member, and a sealing member which surrounds said associated cylinder sleeve and is entrapped between said annular member and said partition member.

7. A compressor according to claim 6 wherein said partition member comprises a first annular groove surrounding an opening for said associated cylinder sleeve for receiving said annular member, wherein said annular member comprises a second annular groove, and wherein said sealing member is entrapped between the first and second annular grooves and is engaged with said cylinder sleeve.

8. A compressor according to claim 5 wherein said components include a fluid line and wherein said sealing means comprises an annular sealing member which surrounds said fluid line and is entrapped between said fluid line and said partition member.

9. A compressor according to claim 8 wherein said fluid line comprises an externally threaded nipple extending through an associated opening in said partition member, wherein said annular sealing member surrounds said nipple and is entrapped between said nipple and the wall of its associated opening, and wherein said sealing means further includes threaded nut means disposed on said threaded nipple for securing said nipple in its associated opening.

10. In a reciprocating gas compressor having a housing which is divided by a partition member therein into an upper suction chamber through which gas passes and a lower crankcase chamber in which a component moves along a path, said suction chamber having two spaced apart locations whereat oil collects and said crankcase chamber having an oil sump wherein oil collects;

conduit means externally connected between said suction chamber and said crankcase chamber to enable oil collected at said location in said suction chamber whereat oil collects to flow by gravity through said lower crankcase chamber clear of said path and into said oil sump, to enable gas to flow in either direction between said suction chamber and said crankcase chamber to equalize gas pressure between the chambers and to enable oil droplets in said gas to flow by gravity through said conduit means, said conduit means comprising first and second tubes, each having one end connected at one of said locations in said suction chamber whereat oil collects, and means for connecting the other ends of said first and second tubes at a location in said crankcase chamber above the level of oil in said oil sump and clear of said path.

* * * * *